US006695715B1

(12) United States Patent
Chikaraishi

(10) Patent No.: US 6,695,715 B1
(45) Date of Patent: Feb. 24, 2004

(54) WOOD CLUB HEAD

(75) Inventor: Toshio Chikaraishi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 4 days.

(21) Appl. No.: 09/715,128

(22) Filed: Nov. 20, 2000

(30) Foreign Application Priority Data

Nov. 18, 1999 (JP) ..... P. 11-328136

(51) Int. Cl.[7] ..... A63B 53/04

(52) U.S. Cl. ..... 473/329; 473/342; 473/345; 473/349

(58) Field of Search ..... 473/329, 332, 473/345, 346, 350, 342, 324, 290, 349

(56) References Cited

U.S. PATENT DOCUMENTS 5,106,094 A * 4/1992 Desbiolles
5,255,918 A * 10/1993 Anderson
5,299,807 A * 4/1994 Hutin
5,310,185 A * 5/1994 Viollaz
5,333,861 A * 8/1994 Mills
5,431,396 A * 7/1995 Shieh
5,467,983 A * 11/1995 Chen
5,499,814 A * 3/1996 Lu
5,524,331 A * 6/1996 Pond
5,743,813 A * 4/1998 Chen
5,863,261 A * 1/1999 Eggiman
5,888,148 A * 3/1999 Allen
5,931,746 A * 8/1999 Soong
6,165,081 A * 12/2000 Chou

* cited by examiner

*Primary Examiner*—Sebastiano Passaniti
(74) *Attorney, Agent, or Firm*—Sughrue Mion, PLLC

(57) ABSTRACT

In a wood club head having a hollow metal shell structure with a double face constituted by a front face and a rear face which is disposed behind the front face through an air gap of predetermined width, there is provided a characteristic that when a golf ball is made to collide with the front face at an entrance speed (head speed) V (m/s), the restitution coefficient of the face is in a range of from 0.84 to 0.88 when the entrance speed V is in a range of from 35 to 40 (m/s), and not lower than 0.80 and lower than 0.83 when the entrance speed V is in a range of from 48 to 53 (m/s).

8 Claims, 2 Drawing Sheets

FIG. 3

| | EXAMPLE 1 | EXAMPLE 2 | EXAMPLE 3 | COMPARATIVE EXAMPLE 1 | COMPARATIVE EXAMPLE 2 | CONVENTIONAL EXAMPLE |
|---|---|---|---|---|---|---|
| MATERIAL THICKNESS (mm) | β TITANIUM 1.5 | β TITANIUM 1.7 | β TITANIUM 2.0 | β TITANIUM 2.0 | β TITANIUM 2.0 | β TITANIUM 3.0 |
| MATERIAL THICKNESS (mm) | β TITANIUM 2.0 | β TITANIUM 2.0 | β TITANIUM 2.0 | β TITANIUM 2.0 | NONE | NONE |
| WIDTH OF GAP THICKNESS (mm) | 0.5 | 0.5 | 0.5 | 1.5 | NONE | NONE |
| RESTITUTION COEFFICIENT V = 35 V = 49 (m/s) | 0.868 0.825 | 0.864 0.822 | 0.860 0.820 | 0.861 0.833 | 0.862 0.832 | 0.834 0.802 |
| DURABILITY | NO PROBLEM | NO PROBLEM | NO PROBLEM | BROKEN | BROKEN | NO PROBLEM |

WOOD CLUB HEAD

BACKGROUND OF THE INVENTION

1. Field of the Invention

The present invention relates to the characteristic and structure of a face of a wood club head.

2. Description of the Related Art

In order to enhance the carry distance of a hit ball, recently, there have been made various attempts to give large repulsion force from a face to a golf ball when the ball is hit by the face.

This repulsion force is based on the deformation of the face produced at impact. Generally, it is considered that the repulsion force can be increased by increasing the area of the face and by thinning the thickness of the face.

However, when such measures are enhanced, there arises a problem that the face is deformed so excessively that, for example, when a muscular golfer gives a hard impact to a ball, the durability of the face is lost. Therefore, there has been a proposal in which a rear face is disposed behind a face (that is, a front face which is to be a hitting surface) so as to form a double-face structure. The rear face is made to be substantially as large as the front face so that the load at impact on the front face is shared between both the front and rear faces.

In reality, however, it cannot be the that any face having such a double-face structure suggested hitherto brings out its own repulsion force satisfactorily.

For example, in a face having a double-face structure, as disclosed in JP-A-11-192329, a front face is too thick and it is neglected to consider the face area which can be represented by the height of the face. As a result, the increase of the carry distance expected on the basis of the repulsion force is not brought out satisfactorily in comparison with background-art products.

On the other hand, recently, United States Golf Association (USGA) established rules on the spring effect of a head face, and there arose a situation that "an officially recognized club is only a club having a restitution coefficient (e) which is lower than 0.83 when the entrance speed (V) of a golf ball is 48.768 m/s". In consideration of this situation as well as the durability of a face, there is a limit in the attempt that the thickness of a face having a double-face structure is made extremely thin in order to obtain high repulsion force.

SUMMARY OF THE INVENTION

In consideration of such actual circumstances, it is an object of the present invention to provide a wood club head which meets the golf rules while repulsion force of a face is brought out satisfactorily, and the durability of the face is ensured.

In order to attain the foregoing object, according to an aspect of the present invention, there is provided a wood club head having a hollow metal shell structure in which a face is constituted by a front face which is to be a hitting surface and a rear face which is disposed behind said front face through an air gap of predetermined width; wherein when a golf ball is made to collide on said front face at an entrance speed V (m/s), a restitution coefficient of said front face is in a range of from 0.84 to 0.88 in a case where said entrance speed V is in a range of from 35 to 40 (m/s), while said restitution coefficient of said front face is not lower than 0.80 but lower than 0.83 in a case where said entrance speed V is in a range of from 48 to 53 (m/s).

In order to make the characteristic of repulsion force of a face clear, the inventor of the present invention investigated, by experiments, the relationship between the restitution coefficient of a face at impact and the entrance speed (which is a speed of a golf ball colliding on a face of a head standing still according to the USGA rules, which will be described later, the speed having a value corresponding to the head speed conversely when the ball standing still is hit by the club head).

As shown in FIG. 2, generally, the restitution coefficient (e) shows a tendency to decrease with the increase of the aforementioned entrance speed (V), and has a characteristic of depending on the thickness of the face which is to be a hitting surface. That is, the restitution coefficient of the face becomes higher as the face is thinner. It is considered that this is because deformation bending of each face at impact varies in accordance with its own thickness so that its own repulsion force changes. In order to obtain large repulsion force, it will go well if the deformation is increased within the region of elastic deformation.

In addition, because the repulsion force is a spring effect, proper repulsion force cannot be obtained if deformation exceeds the yield point of the material of the face or belongs to plastic deformation.

According to the present invention, such characteristics are used in combination with one another. For average gofers, the thickness of a front face which is to be a hitting surface is set to be so thin that the restitution coefficient (e) takes a high value in a range of from 0.84 to 0.88 in the case of a general head speed (that is, the aforementioned entrance speed) of not higher than 45 m/s, particularly in a range of from 35 m/s to 40 m/s. In addition, when the head speed (V) is higher than 40 m/s and particularly lower than 48.768 m/s which is a requirement of the aforementioned golf rule, a rear face which is disposed behind the front face so as to be close thereto comes in contact with the deformed portion of the front face so as to restrain the backward deformation of the front face and reduce the value of the restitution coefficient suddenly. Thus, the restitution coefficient at the head speed (that is, the entrance speed) (V) of 48.768 m/s is set to be lower than 0.83 to meet the aforementioned golf rule. On the other hand, for highly skilled golfers, the restitution coefficient is set to be not lower than 0.80 and lower than 0.83 when the head speed is not lower than 48 m/s, particularly in a range of from 48 m/s to 53 m/s.

According to the present invention, the characteristic of the face is set to be suitable in accordance with the head speed of any player. Accordingly, it is possible to expect the increase of the carry distance on the basis of a high restitution coefficient particularly for an ordinary-skilled player whose head speed is not higher than 45 m/s and who has not been satisfied with his/her own carry distance for a long time.

In addition, the restitution coefficient at the head speed of 48.768 m/s is lower than 0.83 according to the aforementioned golf rule, so that the club can be made to meet the aforementioned USGA rules.

Further, when the head speed is not lower than 48 m/s, the thickness of the front face and the distance of an air gap provided behind the front face are selected to take proper values so that the restitution coefficient can be set to be not lower than 0.80 and lower than 0.83, which will be described later. Thus, enough carry distance and durability are ensured.

Incidentally, if the restitution coefficient is lower than 0.84 when the head speed is in a range of from 35 m/s to 40 m/s, golfers whose head speeds are low cannot obtain satisfactory carry distances. On the contrary, if the restitution coefficient exceeds 0.88, there is a fear that the front face is broken in accordance with the material thereof.

Further, if the restitution coefficient is lower than 0.80 when the head speed is in a range of from 48 m/s to 53 m/s, it is difficult to obtain enough carry distance even if the head speed is high. On the contrary, if the restitution coefficient is not lower than 0.83, there is a fear on the contravention of the aforementioned USGA golf rules or on the durability of the face.

In addition, according to a second aspect of the present invention, preferably, the thickness of the front face is made equal to or thinner than that of the rear face, and the value of the thickness is made not thinner than 1.3 mm and thinner than 2.0 mm.

Thus, it is possible to ensure necessary rigidity of the rear face which accommodates the deformation of the front face, and it is possible to produce a high restitution coefficient while the front face is made as thin as possible.

Incidentally, if the thickness of the front face is thinner than 1.3 mm, there arises a problem on the durability of the front face. On the contrary, if the front face is not thinner than 2.0 mm, enough deformation cannot be obtained at impact, so that it is not possible to bring out a sufficient restitution coefficient. As a result, the carry distance is lowered.

BRIEF DESCRIPTION OF DRAWINGS

FIG. 3 is a table showing results of tests for estimating heads according to examples.

DETAILED DESCRIPTION OF THE PRESENT INVENTION

An embodiment of the present invention will be described below with reference to FIGS. 1 to 3.

Figure 1:
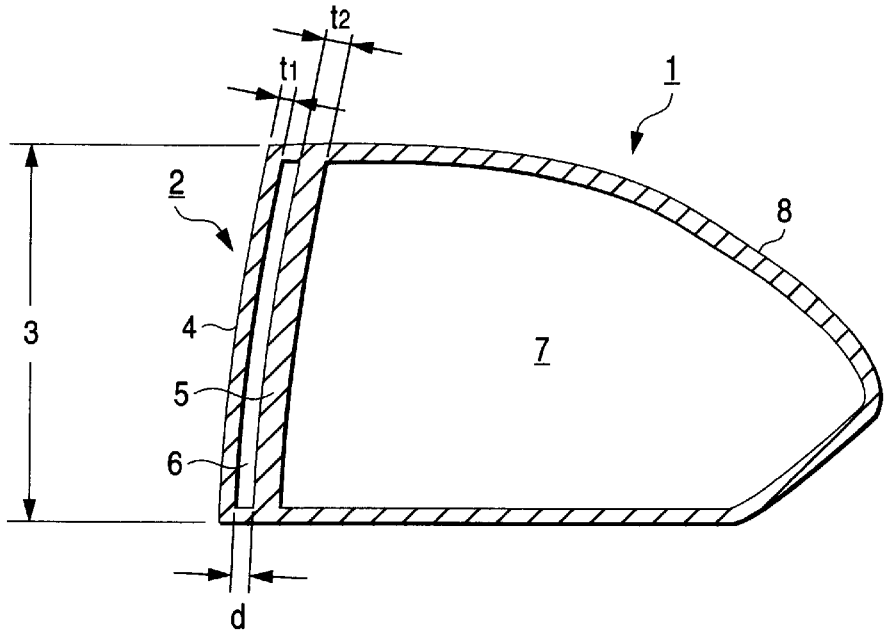
FIG. 1 is a sectional view taken on the center of a face of a head according to an embodiment of the present invention.
Figure 2:
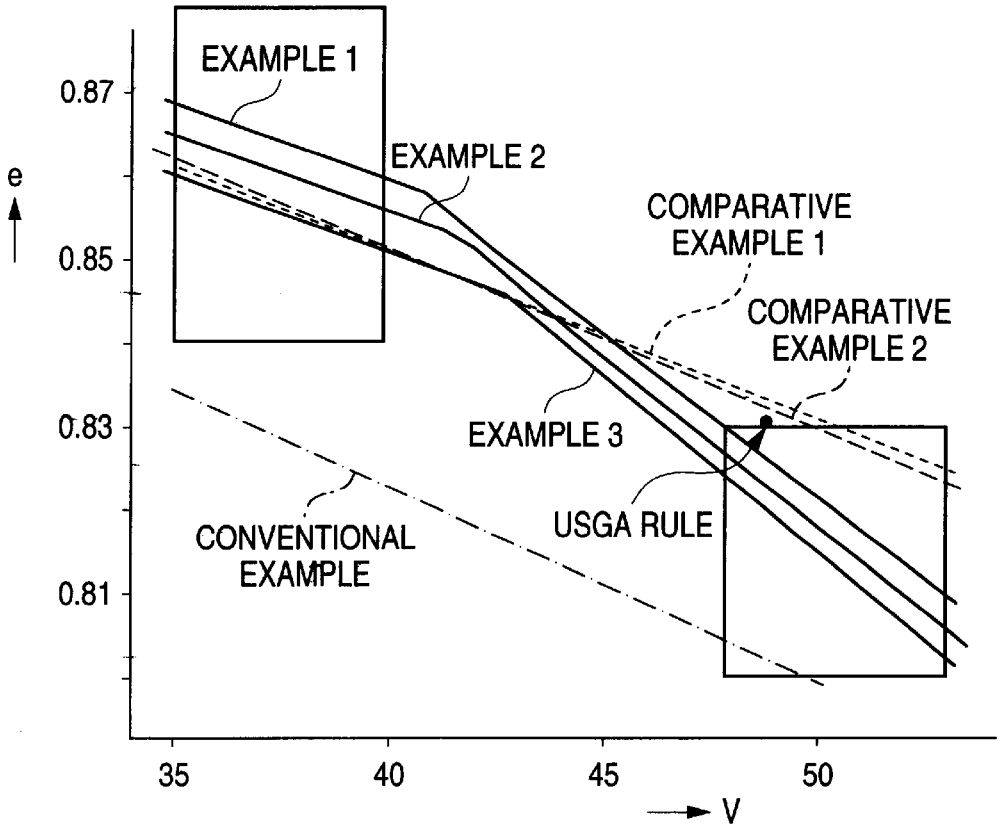
FIG. 2 is a graph showing the relationship between the restitution coefficient of a face and the head speed.

FIG. 1 is a sectional view at the face center of a head in a driver wood club according to an embodiment of the present invention. A head 1 is configured so that the head volume is 280 ml (280 $cm^3$), the head mass is 195 gr (4.9 N), the face area is 3,600 $mm^2$ when the surface of a face 2 is front-viewed from the vertical direction thereof, and face height 3 regarded as a distance from the lowest position of the face outline to the highest position thereof is 45 mm The whole of the head 1 is manufactured out of a titanium alloy.

The face 2 is provided in front of the head 1 and constituted by a front face 4 which is to be a hitting surface and a rear face 5 which is formed behind the front face 4 through an air gap 6 of a predetermined distance. The rest portion of the head 1 is formed as a thin shell structure 8 having a cavity 7 internally.

First, the relationship between the restitution coefficient (e) of the front face 4 having the aforementioned area and the head speed (entrance speed) (V) is grasped with the thickness ($t_l$) of the front face 4 as parameter (FIG. 2), by experiments using a measuring method according to the USGA rules which will be described later.

Thus, the thickness ($t_l$) of the front face is set to be not thinner than 1.3 mm but thinner than 2.0 mm so that the restitution coefficient takes a value in a range of from 0.84 to 0.88 when the head speed is in a range of from 35 m/s to 40 m/s, and the deformation of the front face 4 is within the region of elastic deformation. As a result, the repulsion force of the front face 4 can be brought out to the utmost without losing the durability of the face.

Next, the distance (d) of the air gap 6 is established as follows. For every front face the thickness of which is selected in advance, the deformation quantity of the front face 4 when a ball is hit at a head speed varied in a range of from 41 m/s to 47 m/s is measured beforehand. The rear face 5 is disposed behind the front face 4 so that the back surface of the front face 4 comes in contact with the front surface of the rear face 5 just when a ball is hit at a predetermined head speed.

Incidentally, it was confirmed by experiments (the detailed contents of these experiments are omitted) that when the front face 4 was not thinner than 1.3 mm and thinner than 2.0 mm and had the aforementioned area, the maximum deformation quantity with which the front face 4 could be deformed in the form of elastic deformation without reaching the yield point thereof when a ball was hit on the condition that the head speed was in a range of from 41 m/s to 47 m/s, was in a range of from 0.3 mm to 1.2 mm. It is therefore preferable that the distance of the air gap 6 is set to take a value a little smaller value than the value of the deformation quantity, that is, to be in a range of from 0.2 mm to 1.0 mm, more preferably in a range of from 0.3 mm to 0.6 mm. In this embodiment, the distance is set to be 0.5 mm.

On the other hand, the thickness ($t_2$) of the rear face 5 is set to give enough rigidity to the rear face 5 so that the rear face 5 is prevented from being pressed and from being deformed toward the rear of the head when the front face 4 abuts against the rear face 5 due to ball hitting. It is preferable that the thickness ($t_2$) is selected to be in a range of from 1.5 mm to 2.3 mm to be thicker than the front face. However, it is not preferable that the rear face 5 is so thick that the thickness ($t_2$) exceeds 2.3 mm, because the head weight increases. In this embodiment, the thickness ($t_2$) is set to be 2.0 mm.

When the face 2 of the head 1 is configured thus, in the case of Embodiment 1, the deformation of the front face 4 is realized in the form of elastic deformation without any interference of the rear face 5 in the case where a ball is hit at a head speed of lower than 41 m/s. Accordingly, the carry distance of the club head can be enhanced conspicuously without losing the kinetic energy of the head. On the other hand, in the case where a ball is hit at a head speed of not lower than 41 m/s, the most deformed portion of the front face 4 comes in contact with the rear face 5 so that the deformation is restrained on a large scale. As a result, the restitution coefficient of the face 2 is lowered suddenly so as to be lower than a value settled under the head speed of 48. 768 m/s according to the USGA rules. Thus, the club head can have a characteristic which meets the USGA rules.

Incidentally, for any golfer whose head speed is not lower than 48 m/s, a club head which can obtain enough carry distance and durability can be provided because the restitution coefficient is kept to take a value in a range which is not lower than 0.80 and lower than 0.83.

Next, in order to confirm the effect of the present invention, as shown in Table 1 of FIG. 3, three kinds of club heads according to Examples 1 to 3, a head of a comparative example 1 with an air gap different in distance and a head of a comparative example 2 with no rear face were manufactured by way of trial. In addition, a conventional head which had a thick front face and no rear face was prepared. Tests for estimating the restitution coefficients and durability of the faces of those heads were performed.

Then, the head speed with which the front face started to abut against the rear face was set to be 41 m/s, 42 m/s and 43 m/s respectively in Examples 1 to 3.

Incidentally, the method for measuring the restitution coefficients was according to the suggestion of the USGA rules, as follows. After a head is put freely on a predetermined table, a golf ball is blasted from a position about 1.4 m away from the head at the speed of 48.768 m/s and with a back spin of 120 rotations per minute by specified equipment. Thus, the blasted golf ball is made to collide with the face, and the speeds before and after the ball collides with the head are measured. The restitution coefficient of the face is calculated by a well-known equation.

Further, for the estimation of the durability, the existence of a crack, a dent, or the like, produced in the face was inquired after a golf ball had been 500 times made to collide with the center of the face at the speed of the golf ball of 50 m/s.

The ball used here was a two-piece ball with ionomer cover on the market in which the hardness was 100 kg (980 N) and the bending quantity at load was about 2.5 mm.

The results of the estimation tests are shown in FIG. 3. It is understood that the restitution coefficient particularly in a head speed of not higher than 40 m/s is much higher in the heads according to the examples than in the conventional example, so that the carry distances for average golfers can be increased conspicuously. In addition, it is understood that the heads can meet the golf rules of USGA and enough carry distance can be obtained also in the case where the head speed is not lower than 48 m/s.

In the head having a double-face structure in the comparative example 1, the distance of the air gap is too long. In the comparative example 2, there is no support against excessive deformation of the front face. As a result, when the head speed is 48.768 m/s, the restitution coefficient exceeds the aforementioned value set in the USGA golf rules. Thus, the heads do not meet the rules. Further, in the durability test, the heads in the comparative examples 1 and 2 were broken because their front faces were deformed large.

Although the rear face 5 is disposed substantially in parallel with the front face 4 so as to go along the whole of the back surface thereof in the respective examples, it will go well if the rear face 5 is disposed along at least a part of the back surface of the area of the front face 4 which is served for ordinarily hitting a ball. The form of the rear face 5 may be selected desirably.

Further, although the material of the head and the face is a titanium alloy in the above-mentioned examples, the material is not limited to this alloy. Stainless steel, pure titanium, an amorphous metal alloy, aluminum, other various alloys or composite materials may be used.

In the wood club head according to the present invention, the face of the head is made to have a double-face structure in which the front face is set to be thinner than the rear face so as to be extremely thin. Accordingly, large bending deformation of the front face can be obtained so that a large restitution coefficient can be produced. Thus, particularly the carry distances of average golfers whose head speeds are low can be increased conspicuously.

On the other hand, when the head speed is high, excessive bending deformation of the front face can be restrained because the rear face is disposed behind the front face through an air gap of proper width. Particularly it is possible to clear the restitution coefficient value set at the head speed of 48.768 m/s according to the USGA rules. In addition, it is possible to increase the carry distances also in the case of higher-grade players, or the like, whose head speeds are higher. Further, the deformation of the face as a whole can be effectively restrained by the high rigidity of the rear face which is made thicker than the front face. It is therefore possible to ensure the durability of the face satisfactorily.

What is claimed is:

1. A wood club head comprising:

a head main body defining a hollow portion, the head main body including a front face forming a hitting face and a rear face disposed behind the front face so as to form a gap of a predetermined width between the front face and the rear face, the rear face having a thickness in a range of 1.5 mm to 2.3 mm, wherein, when a golf ball is made to collide on the front face at an entrance speed V (m/s), a restitution coefficient of the front face is in a range of from 0.84 to 0.88 in a case where the entrance speed V is in a range of from 35 to 40 (m/s).

2. The wood club head according to claim 1, wherein the front face is thinner in thickness than the rear face, and the front face is not thinner than 1.3 mm but thinner than 2.0 mm.

3. The wood club head according to claim 1, wherein the front face and the rear face are made of titanium alloy, stainless steel or amorphous alloy.

4. The wood club head according to claim 1, wherein the gap has thickness in a range of 0.2 mm to 1.0 mm.

5. A wood club head comprising:

a head main body defining a hollow portion, the head main body including a front face forming a hitting face and a rear face disposed behind the front face so as to form a gap of a predetermined width, the rear face having a thickness in a range of 1.5 mm to 2.3 mm, wherein, when a golf ball is made to collide on the front face at an entrance speed V (m/s), a restitution coefficient of the front face is not lower than 0.80 but lower than 0.83 in a case where the entrance speed V is in a range of from 48 to 53 (m/s).

6. The wood club head according to claim 5, wherein the front face and the rear face are made of titanium alloy, stainless steel, or amorphous alloy.

7. The wood club head according to claim 5, wherein the gap has thickness in a 0.2 mm to 1.0 mm.

8. The wood club head according to claim 5, wherein the front face is thinner in thickness than the rear face, and the front face is not thinner than 1.3 mm but thinner than 2.0 mm.

* * * * *